US005797731A

United States Patent [19]

Kobayashi et al.

[11] Patent Number: 5,797,731

[45] Date of Patent: Aug. 25, 1998

[54] GROUP OF FULL-CIRCUMFERENTIAL-FLOW PUMPS AND METHOD OF MANUFACTURING THE SAME

[75] Inventors: Makoto Kobayashi; Masakazu Yamamoto; Yoshio Miyake; Koji Isemoto; Keita Uwai; Yoshiaki Miyazaki, all of Fujisawa, Japan

[73] Assignee: Ebara Corporation, Tokyo, Japan

[21] Appl. No.: 607,264

[22] Filed: Feb. 21, 1996

[30] Foreign Application Priority Data

Feb. 24, 1995 [JP] Japan ..... 7-62189

[51] Int. Cl.[6] ..... F04B 17/03

[52] U.S. Cl. ..... 417/238; 417/423.5; 29/888.024

[58] Field of Search ..... 29/888.02, 888.024; 417/423.1, 423.8, 423.12, 423.14, 238, 423.5; 415/199.1, 189.1, 199.2, 60, 61

[56] References Cited

U.S. PATENT DOCUMENTS

| | | | |
|---|---|---|---|
| 3,543,368 | 12/1970 | Marlow . | |
| 3,778,181 | 12/1973 | McFarlin . | |
| 5,385,454 | 1/1995 | Kobayashi et al. | 417/423.12 |
| 5,388,971 | 2/1995 | Kobayashi et al. | 417/423.14 |
| 5,401,146 | 3/1995 | Moriya et al. | 417/423.14 |
| 5,478,215 | 12/1995 | Kobayashi et al. | 417/423.14 |
| 5,494,418 | 2/1996 | Moriya et al. | 417/423.14 |
| 5,563,497 | 10/1996 | Kawaguchi et al. | 417/44.1 |
| 5,564,914 | 10/1996 | Kobayashi et al. | 417/423.7 |
| 5,567,133 | 10/1996 | Kobaybashi et al. | 417/423.14 |
| 5,601,419 | 2/1997 | Kobayashi et al. | 417/423.14 |
| 5,616,013 | 4/1997 | Kobayashi et al. | 417/423.14 |
| 5,648,694 | 7/1997 | Kobayashi et al. | 417/423.14 |

FOREIGN PATENT DOCUMENTS

| | | |
|---|---|---|
| 0 634 827 | 1/1995 | European Pat. Off. . |
| 1 228 583 | 3/1960 | France . |
| 323817 | 8/1920 | Germany . |
| 339137 | 7/1921 | Germany . |

OTHER PUBLICATIONS

U.S. application No. 08/567,235 allowed, Dec. 1995.

U.S. application No. 08/578,897 pending, Dec. 1995.

U.S. application No. 08/598,651 pending, Feb. 1996.

U.S. application No. 08/607,264 pending, Feb. 1996.

*Primary Examiner*—Timothy Thorpe
*Assistant Examiner*—Peter G. Kurytnyk
*Attorney, Agent, or Firm*—Oblon, Spivak, McClelland, Maier & Neustadt, P.C.

[57] ABSTRACT

A group of full-circumferential-flow pumps has a group of motors each comprising a main shaft, a rotor mounted on the main shaft, a stator disposed around the rotor, a cylindrical outer motor frame fitted over the stator, and an outer cylinder disposed around the cylindrical outer motor frame with an annular space defined therebetween, a group of pump parts oriented in opposite directions to meet different directions in which the main shafts of the motors rotate, and a group of frequency converters for energizing the motors to rotate at high speeds. In order to meet rating requirements including flow rates and pump heads, the group of motors, the group of pump parts, and the group of frequency converters are combined to provide a group of single-suction-type full-circumferential-flow pumps that are powered by a commercial electric power supply and belong to a first type for applications to pump a fluid at a small rate under a low pump head, and a group of single-suction-type full-circumferential-flow pumps that are rotatable at high speeds and belong to a second type for applications to pump a fluid at a small rate under a high pump head.

10 Claims, 9 Drawing Sheets

A: SINGLE-SUCTION-TYPE PUMP POWERED BY COMMERCIAL POWER SUPPLY (1 - 4 IMPELLERS)

B: SINGLE-SUCTION-TYPE PUMP ROTATABLE AT HIGH SPEED (2, 3 IMPELLERS)

C: SINGLE-SUCTION-TYPE BALANCED PUMP ROTATABLE AT HIGH SPEED (4 OR MORE IMPELLERS)

D: DOUBLE-SUCTION-TYPE PUMP POWERED BY COMMERCIAL POWER SUPPLY (1 - 4 IMPELLERS)

E: DOUBLE-SUCTION-TYPE PUMP ROTATABLE AT HIGH SPEED (2 OR MORE IMPELLERS)

GROUP OF FULL-CIRCUMFERENTIAL-FLOW PUMPS AND METHOD OF MANUFACTURING THE SAME

BACKGROUND OF THE INVENTION

1. Field of the Invention

The present invention relates to a group of full-circumferential-flow pumps and a method of manufacturing such a group of full-circumferential-flow pumps, and more particularly to a group of full-circumferential-flow pumps which are capable of meeting a wide variety of rating requirements and sharing many parts, and a method of manufacturing such a group of full-circumferential-flow pumps.

2. Description of the Related Art

Full-circumferential-flow pump made of sheet metal and incorporating a canned motor are known in the art. There have been proposed various processes for designing such full-circumferential-flow pumps. However, the conventional designing processes have proven unsatisfactory because there have been established no definite pump classification standards for enabling full-circumferential-flow pumps to meet a wide variety of rating requirements.

For example, it has been the pump designing practice to achieve a high pump head by constructing a multistage pump having a large number of impellers. Such a multistage pump is undesirable because its impellers and other components result in an undue waste of material and it employs large-capacity bearings to withstand large axial thrust forces.

In case of manufacturing pumps having a low pump head and a large flow rate, it has been customary to direct design efforts to manufacture single-suction-type pumps which employ three-dimensional impellers having a large specific speed Ns. Since the three-dimensional impellers cannot easily be formed of sheet metal, such single-suction-type pumps cannot be manufactured efficiently.

SUMMARY OF THE INVENTION

It is therefore an object of the present invention to provide a group of full-circumferential-flow pumps which are capable of meeting a wide variety of rating requirements and sharing many parts, and a method of manufacturing such a group of full-circumferential-flow pumps.

To achieve the above object, according to the present invention, there is provided a group of full-circumferential-flow pumps comprising a group of motors each comprising a main shaft, a rotor mounted on the main shaft, a stator disposed around the rotor, a cylindrical outer motor frame fitted over the stator, and an outer cylinder disposed around the cylindrical outer motor frame with an annular space defined therebetween, a group of pump parts including at least an impeller and arranged to meet a clockwise direction in which the main shafts of the motors rotate, a group of pump parts including at least an impeller and arranged to meet a counterclockwise direction in which the main shafts of the motors rotate, and a group of frequency converters for energizing the motors to rotate at high speeds, the arrangement being such that in order to meet rating requirements including flow rates and pump heads, the group of motors, the group of pump parts, and the group of frequency converters are combined to provide a group of single-suction-type full-circumferential-flow pumps that are powered by a commercial electric power supply and belong to a first type for applications to pump a fluid at a small rate under a low pump head, and a group of single-suction-type full-circumferential-flow pumps that are rotatable at high speeds and belong to a second type for applications to pump a fluid at a small rate under a high pump head.

According to the present invention, there is also provided a method of manufacturing a group of full-circumferential-flow pumps, comprising the steps of providing a group of motors each comprising a main shaft, a rotor mounted on the main shaft, a stator disposed around the rotor, a cylindrical outer motor frame fitted over the stator, and an outer cylinder disposed around the cylindrical outer motor frame with an annular space defined therebetween, providing a group of pump parts oriented in opposite directions to meet different directions in which the main shafts of the motors rotate, providing a group of frequency converters for energizing the motors to rotate at high speeds, and combining, in order to meet rating requirements including flow rates and pump heads, the group of motors, the group of pump parts, and the group of frequency converters to provide a group of single-suction-type full-circumferential-flow pumps that are powered by a commercial electric power supply and belong to a first type for applications to pump a fluid at a small rate under a low pump head, and a group of single-suction-type full-circumferential-flow pumps that are rotatable at high speeds and belong to a second type for applications to pump a fluid at a small rate under a high pump head.

The group of motors, the group of pump parts, and the group of frequency converters may further be combined to provide a group of double-suction-type full-circumferential-flow pumps that are powered by a commercial electric power supply and belong to a third type for applications to pump a fluid at a large rate under a low pump head, a group of double-suction-type full-circumferential-flow pumps that are rotatable at high speeds and belong to a fourth type for applications to pump a fluid at a large rate under a high pump head, and a group of single-suction-type balanced multistage full-circumferential-flow pumps which belong to a fifth type which is included in the second type.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENT

Figure 1:
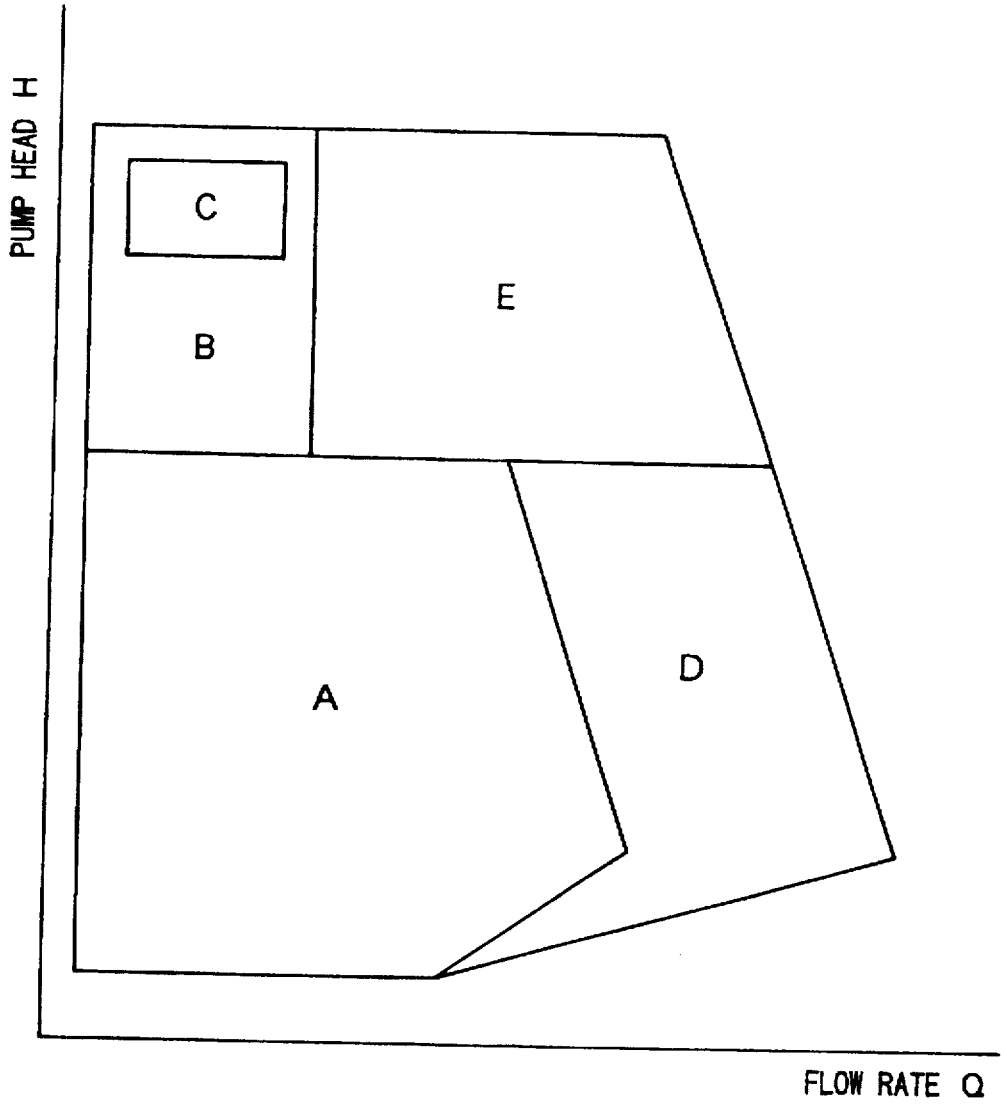
FIG. 1 is a diagram showing types of full-circumferential-flow pumps according to the present invention which are classified according to rating requirements.

FIG. 1 shows types of full-circumferential-flow pumps according to the present invention which are classified according to rating requirements including pump heads and flow rates. In FIG. 1, the horizontal axis represents a flow rate, and the vertical axis represents a pump head.

As shown in FIG. 1, a group of single-suction-type full-circumferential-flow pumps having 1 to 4 impellers and powered by a commercial electric power supply belongs to a type A for applications to pump a fluid at a small rate under a low pump head. A group of single-suction-type full-circumferential-flow pumps having 2 or 3 impellers are rotatable at high speeds and belong to a type B for applications to pump a fluid at a small rate under a high pump head. A group of double-suction-type full-circumferential-flow pumps having 1 to 4 impellers are powered by a commercial electric power supply and belong to a type D for applications to pump a fluid at a large rate under a low pump head. A group of double-suction-type full-circumferential-flow pumps having 2 or more impellers are rotatable at high speeds and belong to a type E for applications to pump a fluid at a large rate under a high pump head. A group of single-suction-type balanced multistage full-circumferential-flow pumps having 4 or more impellers belong to a type C which is included in the type B.

Figure 2:
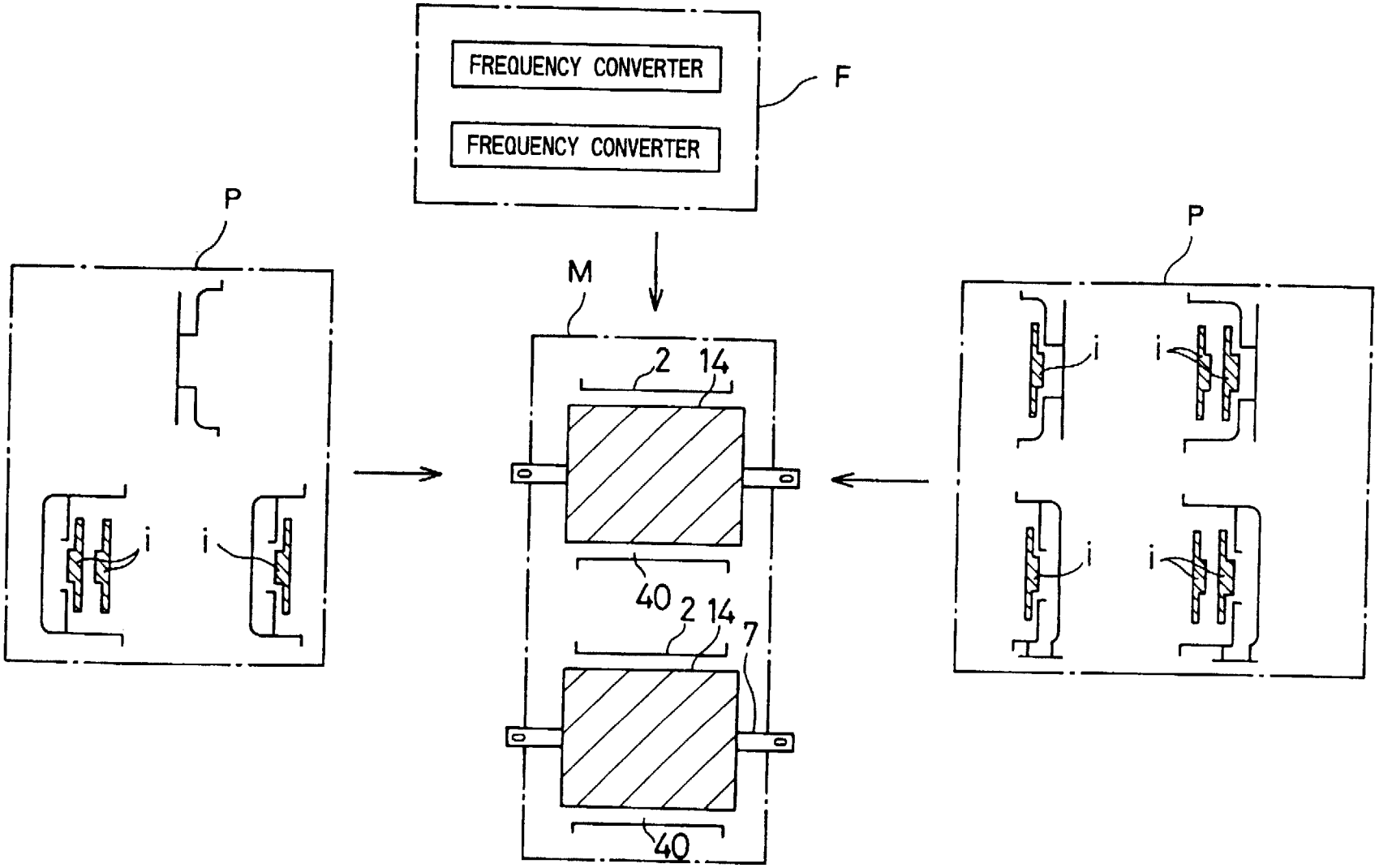
FIG. 2 is a diagram illustrative of a method of manufacturing a group of full-circumferential-flow pumps according to the present invention.

As shown in FIG. 2, the above groups of full-circumferential-flow pumps are constructed by selectively combining a group of motors M including cylindrical outer motor frames 14 fitted over motor stators and outer cylinders 2 disposed around the respective cylindrical outer motor frames 14 with annular spaces 40 defined therebetween, groups of pump parts P including one or more impellers i and oriented in opposite directions so as to form different directions in which main shafts 7 of the motors rotate, and a group of frequency converters F for rotating the motors M at high speeds. The groups of pump parts P comprise a group of pump parts including at least an impeller and arranged to meet a clockwise direction in which the main shafts of the motors rotate and a group of pump parts including at least an impeller and arranged to have a counterclockwise direction in which the main shafts of the motors rotate. The groups of full-circumferential-flow pumps can be constructed by combining the motors M, the pump parts P, and the frequency converters F in various combinations. The number of impellers i in a pump is determined depending on the pump head. Thus, for example, within the pump group of type A, those having the highest pump head will have 4 impellers. Specific numbers of impellers i in the various groups of full-circumferential-flow pumps are shown in FIG. 1.

Specific structural details of each of the single-suction-type full-circumferential-flow pumps that are powered by a commercial electric power supply and belong to the type A for applications to pump a fluid at a small rate under a low pump head will be described below with reference to FIG. 3.

Figure 3:
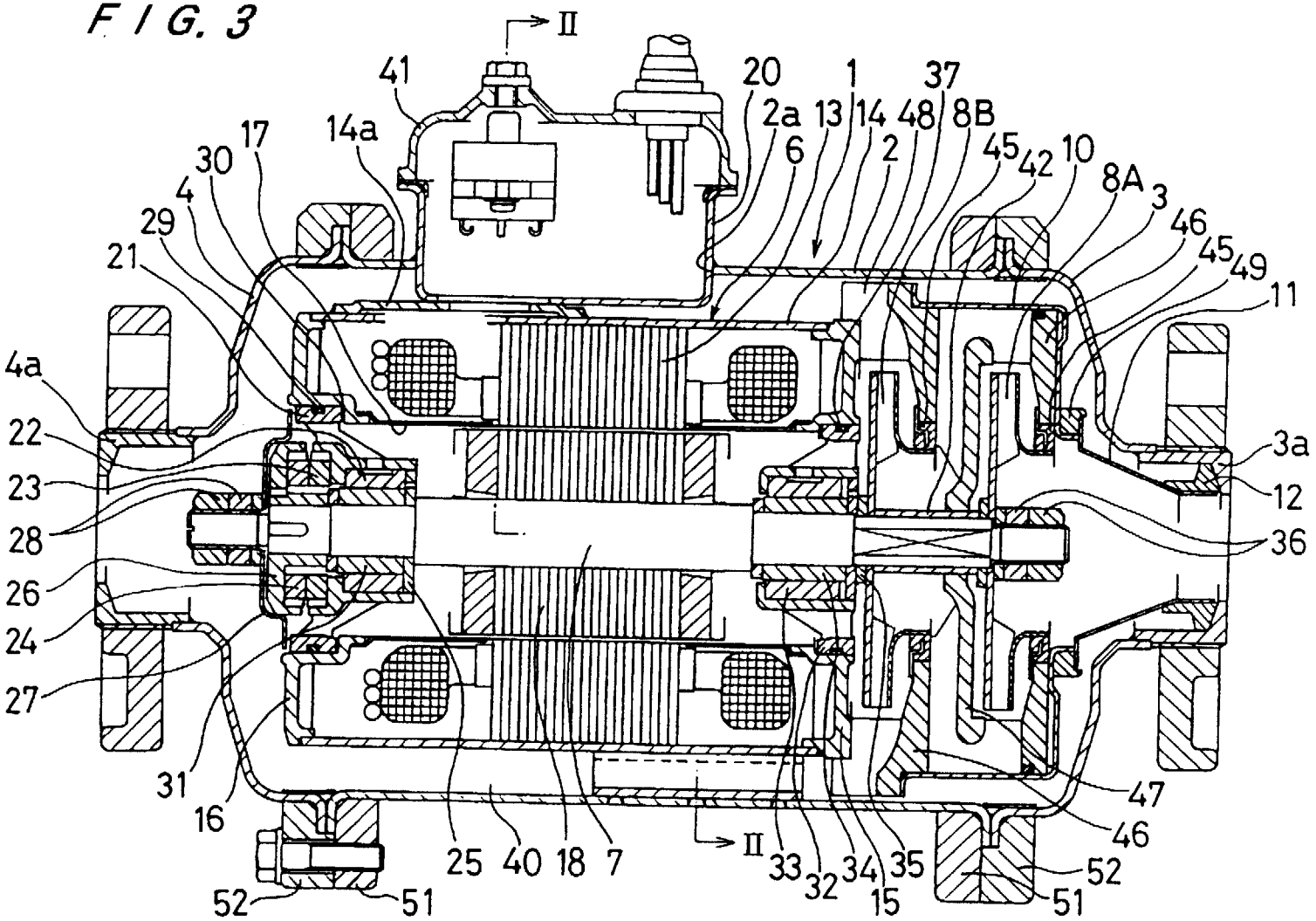
FIG. 3 is a vertical cross-sectional view of one of the full-circumferential-flow pumps according to the present invention.

As shown in FIG. 3, the single-suction-type full-circumferential-flow pump comprises a cylindrical pump casing 1, a canned motor 6 housed in the pump casing 1, and a pair of impellers 8A, 8B fixedly mounted on a main shaft 7 of the canned motor 6. The impellers 8A, 8B have respective suction mouths opening in one axial direction toward a suction tube (described later on). The pump casing 1 comprises an outer cylinder 2, a suction casing 3 connected to an end of the outer casing 2 by flanges 51, 52, and a discharge casing 4 connected to the opposite end of the outer casing 2 by flanges 51, 52. A discharge nozzle **4*a* is fixedly mounted in the discharge casing 4. The outer cylinder 2, the suction casing 3, and the discharge casing 4 are made of sheet metal such as stainless steel. The impellers 8A, 8B will also be referred to as first- and second-stage impellers 8A, 8B**, respectively.

The impellers 8A, 8B are housed in an inner casing 10 disposed in the outer cylinder 2 and the suction casing 3. The inner casing 10 houses therein a pair of axially spaced retainers 46 positioned axially adjacent to the impellers 8A, 8B, respectively, and retaining respective liner rings 45 disposed around the suction mouths of the impellers 8A, 8B, a return blade 47 positioned axially between the impeller 8A and the retainer 46 located axially adjacent to the impeller 8B, for guiding a fluid discharged from the first-stage impeller 8A toward the second-stage impeller 8B, and a guide unit 48 joined to the retainer 46 adjacent to the second-stage impeller 8B and extending around the impeller 8B, for guiding a fluid discharged radially outwardly from the second-stage impeller 8B to flow axially upwardly.

The suction casing 3 houses therein a suction tube 11 having an inner axial end joined to a suction inlet of the inner casing 10 through a seal 49. The suction tube 11 has an outer axial end connected to a suction nozzle **3*a* which is fixedly mounted in a distal end of the suction casing 3. A resilient annular seal 12 disposed around the outer axial end of the suction tube 11 and held against the suction nozzle 3*a***.

The canned motor 6 comprises a stator 13, a cylindrical outer motor frame 14 fitted over the stator 13, a pair of axially spaced side frame plates 15, 16 welded respectively to axially opposite open ends of the outer motor frame 14, and a cylindrical can 17 fitted in the stator 13 and having axially opposite ends welded to the side frame plates 15, 16. The canned motor 6 also has a rotor 18 rotatably housed in a rotor chamber defined in the can 17 in radial alignment with the stator 13 and shrink-fitted over the main shaft 7. The outer motor frame 14 is fixedly supported in and spaced radially inwardly of the outer cylinder 2 with an annular fluid passage 40 defined therebetween.

A terminal case 20 which is welded to the outer motor frame 14 contains terminals to which leads from the coils in the outer motor frame 14 are connected. The terminals in the terminal case 20 are also connected to power supply cables (not shown).

The outer cylinder 2 has a hole **2*a* defined in a circumferential wall thereof, and the terminal case 20 is inserted in the hole 2*a* and sealingly welded to the outer cylinder 2. The terminal case 20 has an outer open end closed by an upper cover 41 fixed thereto. The terminal case 20 has an inner bottom wall resting on a flat outer surface of a box seat plate 14*a* which is welded to an outer circumferential surface of the outer motor frame 14. The box seat plate 14*a* may alternatively be integrally formed with the outer motor frame 14**.

The main shaft 7 is rotatably supported by bearing assemblies disposed in the rotor chamber and positioned on respective end portions thereof. The bearing assemblies can be lubricated by a flow of the fluid which is introduced into the rotor chamber of the canned motor 6.

The bearing assembly, which is positioned remotely from impellers 8A, 8B, comprises a bearing bracket 21 which supports a radial bearing 22 and a fixed thrust bearing 23 that is positioned adjacent to the radial bearing 22. The radial bearing 22 has an end face serving as a fixed thrust sliding member. The bearing assembly also includes a rotatable thrust bearing 24 as a rotatable thrust sliding member positioned axially facing the fixed thrust bearing 23, and a thrust collar 25 supported by the bearing bracket 21. The rotatable thrust bearing 24 and the thrust collar 25 are positioned one on each side of the radial bearing 22 and the fixed thrust bearing 23. The rotatable thrust bearing 24 is fixed to a thrust disk 26 which is fixedly mounted on the main shaft 7 by nuts 28 threaded over an externally threaded end of the main shaft 7. The thrust disk 26 is covered with a sand slinger 27 for preventing sand and other foreign matter from being introduced into the rotor chamber.

The bearing bracket 21 is inserted in a socket in the side frame plate 16 through a resilient O-ring 29. The bearing bracket 21 is axially held against the side frame plate 16 through a resilient gasket 30. The radial bearing 22 is slidably mounted on a sleeve 31 which is mounted on the main shaft 7.

The bearing assembly, which is positioned closely to the impellers 8A, 8B, includes a bearing bracket 32 supporting a radial bearing 33 that is slidably mounted on a sleeve 34 which is mounted on the main shaft 7. The sleeve 34 is axially held against a washer 35 which is fixed to an end portion of the main shaft 7 through the impeller 8B, a sleeve 42, and the impeller 8A by nuts 36 threaded over an externally threaded end of the main shaft 7. The bearing bracket 32 is inserted in a socket in the side frame plate 15 through a resilient O-ring 37. The bearing bracket 32 is axially held against the side frame plate 15.

Operation of the single-suction-type full-circumferential-flow pump shown in FIG. 3 will be described below.

A fluid which is drawn in through the suction nozzle 3*a* and the suction tube 11 flows into the first- and second-stage impellers 8A, 8B in the inner casing 10, which increase the pressure of the fluid. The fluid which is discharged radially outwardly from the second-stage impeller 8B is guided by the guide unit 48 to flow axially. The fluid is then introduced into the annular fluid passage 40 between the outer cylinder 2 and the cylindrical outer motor frame 14, and then flows from the annular fluid passage 40 into the discharge casing 4. The fluid is then discharged through the discharge nozzle 4*a* out of the single-suction-type full-circumferential-flow pump.

The single-suction-type full-circumferential-flow pump shown in FIG. 3 may be combined with the frequency converters F, thereby providing the group of single-suction-type full-circumferential-flow pumps that are rotatable at high speeds and belong to the type B for applications to pump a fluid at a small rate under a high pump head.

Specific structural details of each of the single-suction-type full-circumferential-flow pumps that can belong to both the type A for applications to pump a fluid at a small rate under a low pump head and the type B for applications to pump a fluid at a small rate under a high pump head will be described below with reference to FIG. 4.

Figure 4:
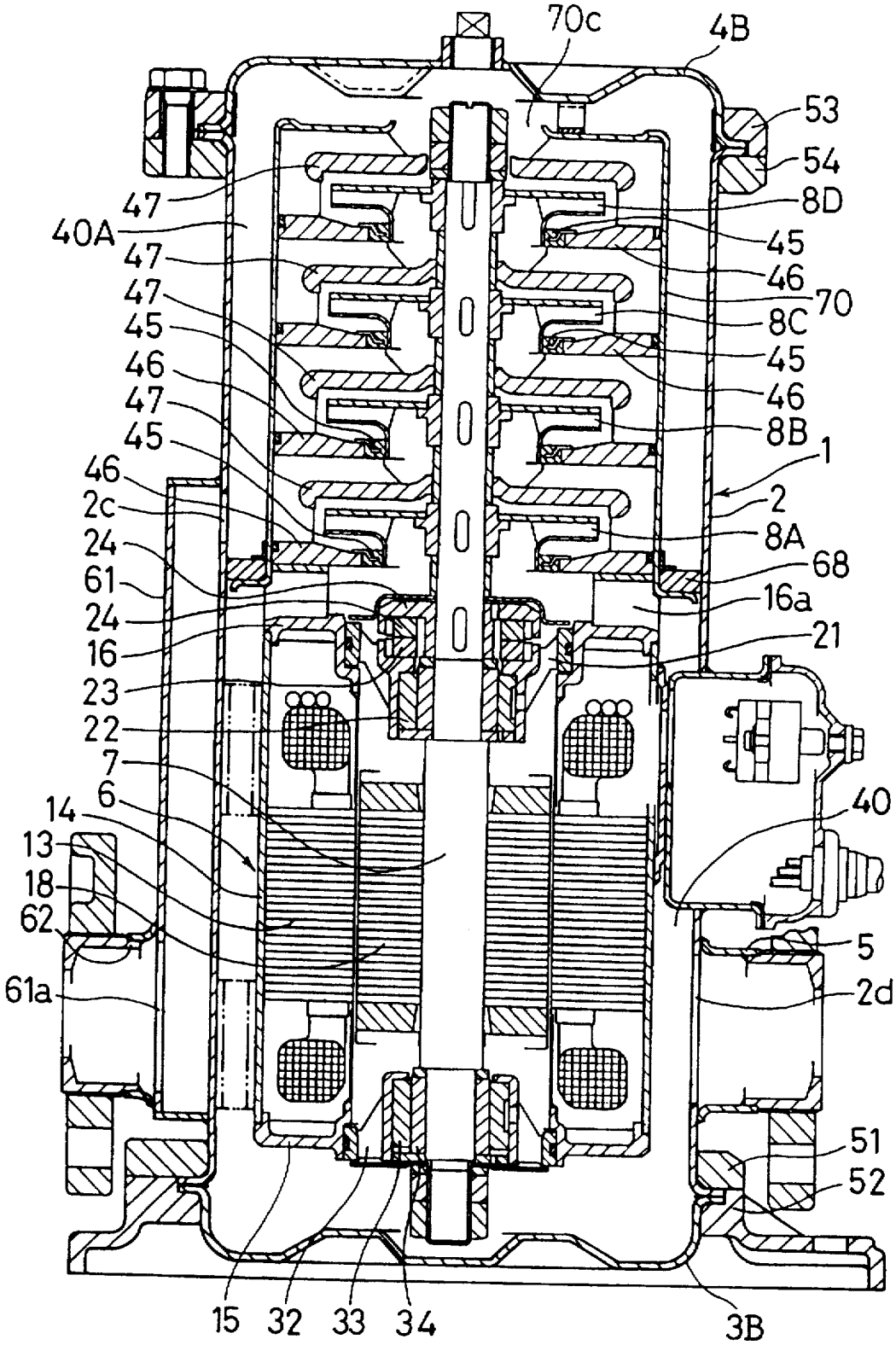
FIG. 4 is a vertical cross-sectional view of another one of the full-circumferential-flow pumps according to the present invention.

As shown in FIG. 4, the single-suction-type full-circumferential-flow pump comprises a vertical multistage pump. Those components shown in FIG. 4 which are identical to those shown in FIG. 3 are denoted by identical reference numerals, and will not be described in detail below. The vertical multistage pump has a canned motor 6 disposed in a pump casing 1 and impellers 8A, 8B, 8C, 8D fixedly mounted on an upper end portion of a main shaft 7 of the canned motor 6. The impellers 8A, 8B, 8C, 8D have respective suction mouths which open axially downwardly, and are housed in a cylindrical inner casing 70 which is disposed in the pump casing 1.

The pump casing 1 comprises an outer cylinder 2 of sheet stainless steel, a cover 3B joined to a lower end of the outer cylinder 2 by flanges 51, 52, and a cover 4B joined to an upper end of the outer cylinder 2 by flanges 53, 54. A suction nozzle 5 is fixed to a lower side wall of the outer cylinder 2 in covering relationship to a suction port 2*d* defined therein and projects radially outwardly.

The outer cylinder 2 has a discharge window 2*c* defined in a middle side wall thereof in diametrically opposite relationship to the suction nozzle 5. The discharge window 2*c* is covered with a discharge pipe 61 which is welded to an outer circumferential surface of the outer cylinder 2. The discharge pipe 61 extends downwardly to a lower portion of the outer cylinder 2, and has a discharge port 61*a* defined in a lower end thereof. A discharge nozzle 62 is fixed to a lower side wall of the discharge pipe 61 around the discharge port 61*a* and projects radially outwardly.

The side frame plate 16 has a plurality of ribs 16*a* extending axially upwardly, and the cylindrical inner casing 70 which houses the impellers 8A, 8B, 8C, 8D and holds a seal 68 around its lower end is supported on upper ends of the ribs 16*a* around the main shaft 7. The inner casing 70 has a discharge opening 70*c* defined in its upper end around the upper end of the main shaft 7.

Liner rings 45 are disposed around the suction mouths of the impellers 8A, 8B, 8C, 8D, respectively, and retained by respective retainers 46 disposed in the inner casing 70. Return blades 47 are disposed downstream of the respective impellers 8A, 8B, 8C, 8D, respectively. Other structural details of the pump shown in FIG. 4 are the same as those of the pump shown in FIG. 3, except that the main shaft 7 is rotatably supported by bearing assemblies that are positioned in an arrangement which is an axial reversal of the bearing assemblies shown in FIG. 3.

Operation of the vertical multistage pump shown in FIG. 4 will be described below.

A fluid which is drawn in through the suction nozzle 5 and the suction port 2*d* flows through the annular fluid passage 40, and then flows through a space between the side frame plate 16 and the lowermost retainer 46 into the first-stage impeller 8A. The fluid which is pressurized by the impellers 8A, 8B, 8C, 8D flows through the discharge opening 70*c* into a space between the cover 4B and the inner casing 70. Thereafter, the fluid enters the annular fluid passage 40A between the outer cylinder 2 and the inner casing 70, and is discharged through the discharge window 2*c* radially outwardly into the discharge pipe 61. The fluid then flows axially downwardly in the discharge pipe 61, and is discharged through the discharge port 61*a* and then through the discharged nozzle 62 out of the pump.

Specific structural details of each of the single-suction-type full-circumferential-flow pumps that are rotatable at high speeds and belong to the type C for applications to pump a fluid at a small rate under a high pump head will be described below with reference to FIGS. 5 and 6.

Figure 5:
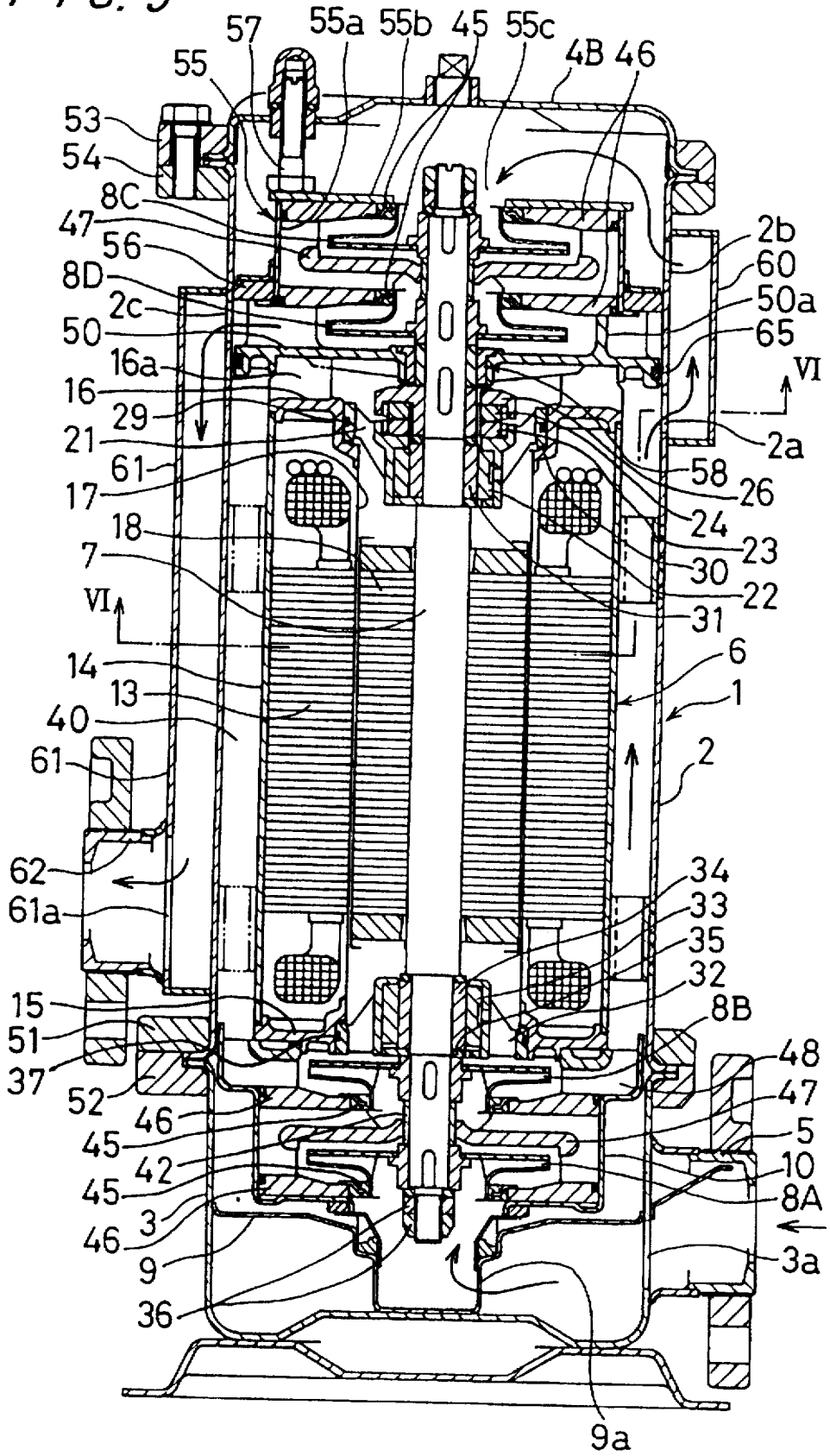
FIG. 5 is a vertical cross-sectional view of still another one of the full-circumferential-flow pumps according to the present invention.
Figure 6:
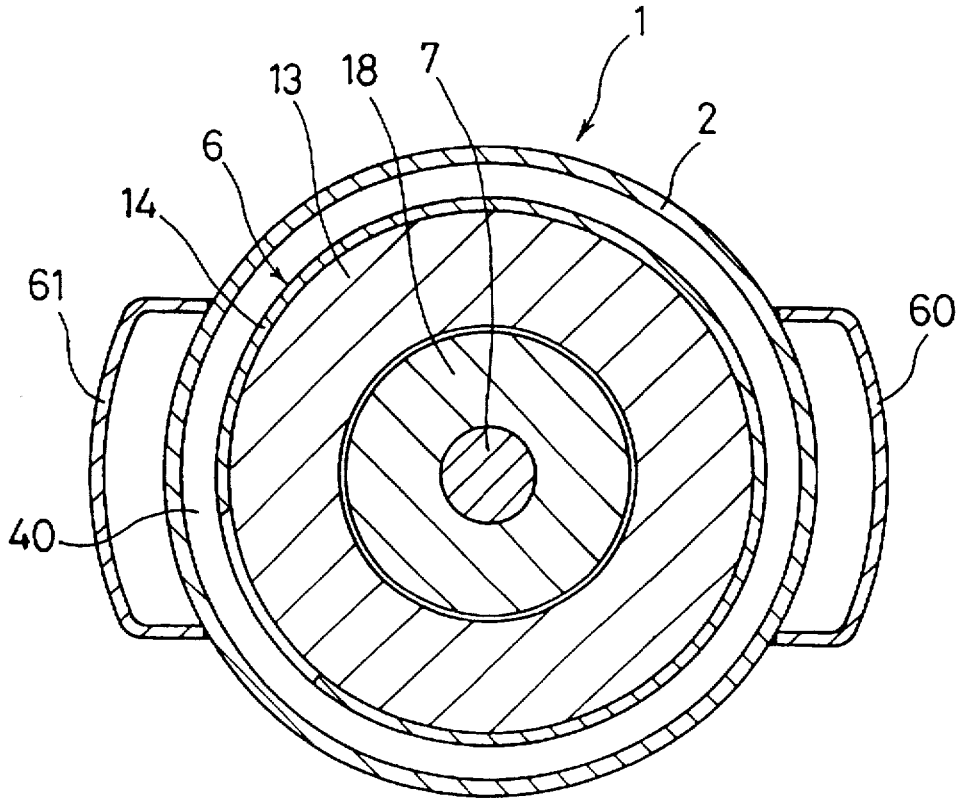
FIG. 6 is a cross-sectional view taken along line VI—VI of FIG. 5.

As shown in FIGS. 5 and 6, the single-suction-type full-circumferential-flow pump comprises a vertical multistage pump. The vertical multistage pump assembly comprises a cylindrical pump casing 1 which houses a canned motor 6 centrally therein. As shown in FIG. 5, the canned motor 6 has a main shaft 7 extending vertically and supporting on its opposite end portions respective pairs of lower impellers 8A, 8B and upper impellers 8C, 8D. The lower impellers 8A, 8B have respective suction mouths which open axially downwardly, and the upper impellers 8C, 8D have respective suction mouths which open axially upwardly. The impellers 8A, 8B, 8C, 8D will also be referred to as first-, second-, third-, and fourth- or final-stage impellers, respectively.

The pump casing 1 comprises an outer cylinder 2 of sheet stainless steel, a suction casing 3 of sheet stainless steel joined to a lower end of the outer cylinder 2 by flanges 51, 52, and a cover 4B of sheet stainless steel joined to an upper end of the outer cylinder 2 by flanges 53, 54. The suction casing 3 has a suction port 3*a* defined in a side wall thereof, and a suction nozzle 5 is fixed to the side wall of the suction casing 3 around the suction port 3*a* and projects radially outwardly. A partition wall 9 is fixedly mounted in the suction casing 3 diametrically across the lower end of the main shaft 7 and has a suction opening 9*a* defined in a central axial boss thereof in communication with the suction port of the first-stage impeller 8A.

The suction casing 3 accommodates an inner casing 10 axially spaced from the partition wall 9 and housing the lower impellers 8A, 8B therein, which are axially spaced from each other. The inner casing 10 also houses therein a pair of axially spaced retainers 46 positioned underneath the lower impellers 8A, 8B, respectively, and retaining respective liner rings 45 disposed around the suction mouths of the lower impellers 8A, 8B, a return blade 47 positioned axially between the impeller 8A and the upper retainer 46 located underneath the impeller 8B, for guiding a fluid discharged from the first-stage impeller 8A upwardly toward the second-stage impeller 8B, and a guide unit 48 positioned above the upper retainer 46 and extending around the impeller 8B, for guiding a fluid discharged radially outwardly from the second-stage impeller 8B to flow axially upwardly.

The canned motor 6 comprises a stator 13, a cylindrical outer motor frame 14 fitted over the stator 13, a pair of axially spaced side frame plates 15, 16 welded respectively to axially opposite open ends of the outer motor frame 14, and a cylindrical can 17 fitted in the stator 13 and having axially opposite ends welded to the side frame plates 15, 16. The canned motor 6 also has a rotor 18 rotatably housed in a rotor chamber defined in the can 17 in radial alignment with the stator 13 and shrink-fitted over the main shaft 7. The outer motor frame 14 is fixedly supported in and spaced radially inwardly of the outer cylinder 2 with an annular fluid passage 40 defined therebetween.

The side frame plate 16 has a plurality of ribs 16*a* extending axially upwardly, and a radial partition wall 50 is supported on upper ends of the ribs 16*a* around the main shaft 7. The partition wall 50 has a seal member 65 at its outer end. The partition wall 50 has a volute 50*a* extending in surrounding relationship to the fourth-stage or final-stage impeller 8D, which is positioned below the third-stage impeller 8C. The partition wall 50 has a socket defined in its upper end. The third-stage impeller 8C is housed in an inner casing 55 which is positioned in an upper end portion of the outer cylinder 2 and has a lower end fitted in the socket of the partition wall 50. The partition wall 50 supports on its inner end a shaft seal 58 disposed around the main shaft 7 for preventing the fluid from leaking along the main shaft 7.

The inner casing 55 is of a substantially cylindrical shape and comprises a cylindrical wall 55*a* and an upper end cover 55*b* joined to an upper end of the cylindrical wall 55*a*. A resilient annular seal 56 is fixed to and extends around a lower end of the cylindrical wall 55*a*. The resilient annular seal 56 is held against an inner surface of the outer cylinder 2 for preventing a fluid being handled from leaking from a discharge region back into a suction region in the pump assembly. The cover 55*b* has a central suction opening 55*c* defined therein in communication with the suction port of the third-stage impeller 8C.

The inner casing 55 and the partition wall 50 are supported on the side frame plate 16 by a bolt 57 which is fastened to the cover 4B and presses the inner casing 55 axially downwardly. The inner casing 55 houses therein a pair of axially spaced retainers 46 positioned above the upper impellers 8C, 8D, respectively, and retaining respective liner rings 45 disposed around the suction mouths of the upper impellers 8C, 8D, and a return blade 47 positioned axially between the impeller 8C and the lower retainer 46 located above the impeller 8D, for guiding a fluid discharged from the third-stage impeller 8C downwardly toward the final-stage impeller 8D. The retainers 46 and the return blade 47 housed in the inner casing 55 are identical to the retainers 46 and the return blade 47 housed in the inner casing 10.

The outer cylinder 2 has a pair of axially spaced communication holes 2*a*, 2*b* defined in an upper portion thereof. The communication holes 2*a*, 2*b* are connected to each other by a communication pipe 60 (see also FIG. 6) which is welded to an outer circumferential surface of the outer cylinder 2 in covering relationship to the communication holes 2*a*, 2*b*. The outer cylinder 2 also has a discharge window 2*c* defined in an upper portion thereof in diametrically opposite relationship to the communication holes 2*a*, 2*b*. The discharge window 2*c* is covered with a discharge pipe or case 61 which is welded to an outer circumferential surface of the outer cylinder 2. The discharge pipe 61 extends downwardly to a lower portion of the outer cylinder 2, and has a discharge port 61*a* defined in a lower end thereof. A discharge nozzle 62 is fixed to a lower side wall of the discharge pipe 61 around the discharge port 61*a* and projects radially outwardly.

Other structural details of the vertical multistage pump shown in FIGS. 5 and 6 are identical to those of the pump shown in FIG. 3.

Operation of the vertical multistage pump assembly shown in FIGS. 5 and 6 will be described below.

A fluid which is drawn in through the suction nozzle 5 and the suction port 3*a* flows through the suction opening 9*a* into the first- and second-stage impellers 8A, 8B, which increase the pressure of the fluid. The fluid which is discharged radially outwardly from the second-stage impeller 8B is guided by the guide unit 48 to flow axially upwardly. The fluid is then introduced upwardly into the annular fluid passage 40 between the outer cylinder 2 and the cylindrical outer motor frame 14, and then flows from the annular fluid passage 40 through the communication hole 2*a*, the communication pipe 60, the communication hole 2*b* into a space defined between the cover 4B and the upper end of the outer cylinder 2. The fluid then flows into the third- and final-stage impellers 8C, 8D, which increase the pressure of the fluid. The fluid which is discharged by the final-stage impeller 8D is guided by the volute 50*a*, and discharged through the discharge window 2*c* radially outwardly into the discharge pipe 61. The fluid then flows axially downwardly in the discharge pipe 61, and is discharged through the discharge port 61*a* and then through the discharged nozzle 62 out of the pump.

Specific structural details of each of the double-suction-type full-circumferential-flow pumps that are powered by a commercial electric power supply and belong to the type D for applications to pump a fluid at a large rate under a low pump head will be described below with reference to FIG. 7.

Figure 7:
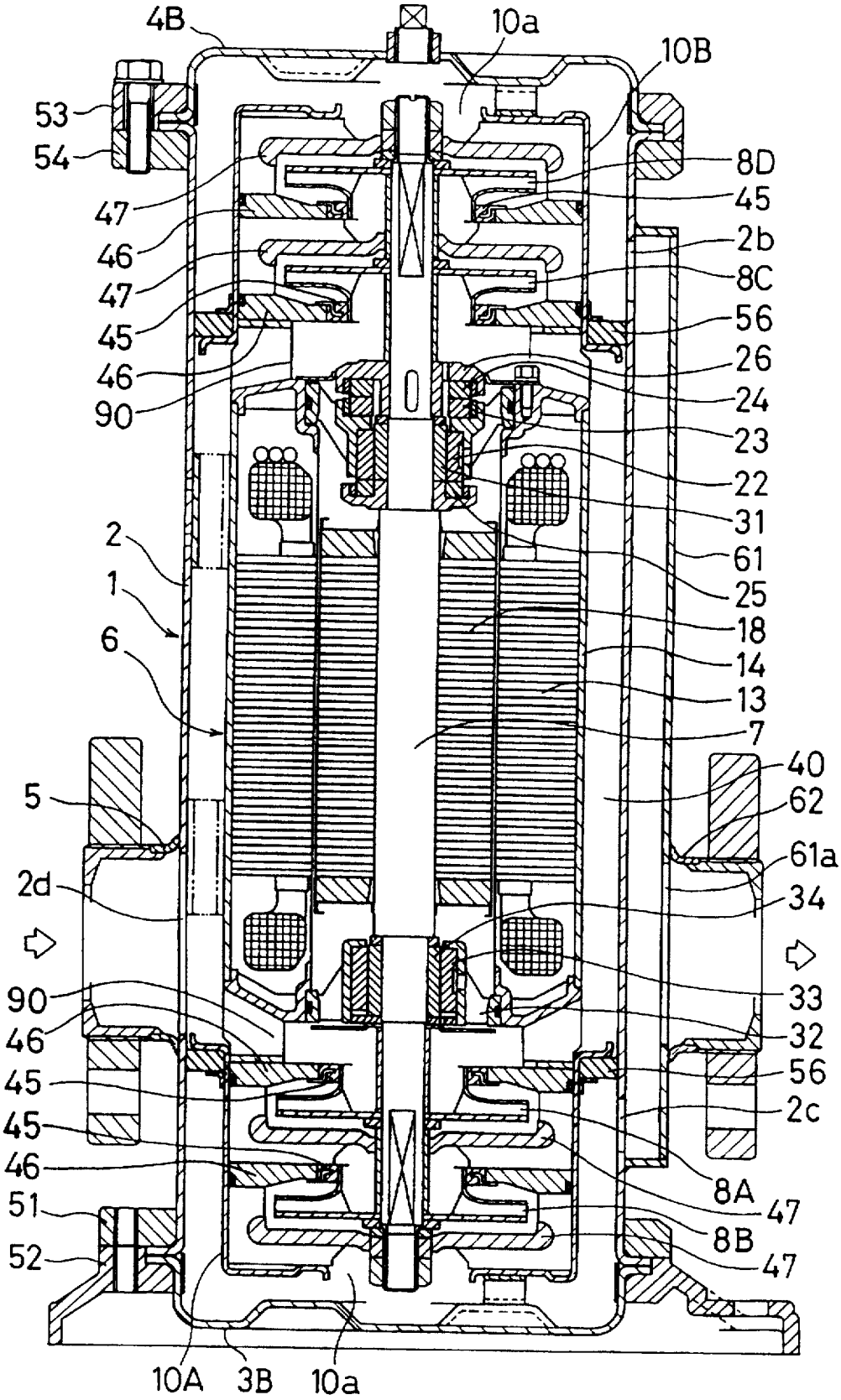
FIG. 7 is a vertical cross-sectional view of still another one of the full-circumferential-flow pumps according to the present invention.

As shown in FIG. 7, the double-suction-type full-circumferential-flow pump comprises a pump casing 1, a canned motor 6 disposed centrally therein, and pairs of impellers 8A, 8B and impellers 8C, 8D mounted respectively on opposite ends of a main shaft 7 of the canned motor 6. The impellers 8A, 8B have respective suction mouths opening axially upwardly, and the impellers 8C, 8D have respective suction mouths opening axially downwardly. The pairs of impellers 8A, 8B and impellers 8C, 8D are part of respective pump units that are positioned axially one on each side of the canned motor 6. These pump units have the same shut-off head but different flow rates. The canned motor 6 and the impellers 8A, 8B and 8C, 8D are housed in an outer cylinder 2 and a pair of end covers 3B, 4B. The end covers 3B, 4B are removably joined respectively to opposite ends of the outer cylinder 2 by flanges 51, 52 and 53, 54, respectively.

The outer cylinder 2 has a suction port 2*d* defined in its circumferential wall and axially spaced discharge windows 2*b*, 2*c* defined in its circumferential wall near the respective opposite ends thereof in diametrically opposite relationship to the suction port 2*d*. A suction nozzle 5 is fixed to the outer circumferential surface of the outer cylinder 2 over the suction port 2*d*. A discharge pipe 61 is mounted on the outer circumferential surface of the outer cylinder 2 over the discharge windows 2*b*, 2*c*, thus interconnecting the discharge windows 2*b*, 2*c*. The discharge pipe 61 has a discharge port 61*a* opening therein in diametrically opposite relationship to the suction port 2*d*. A discharge nozzle 62 is fixed to the outer surface of the discharge pipe 61 over the discharge port 61*a*.

The outer cylinder 2 houses therein axially spaced inner casings 10A, 10B which accommodate the respective pairs of impellers 8A, 8B and 8C, 8D. The inner casings 10A, 10B, each of which is substantially in the form of a cylindrical container, carry resilient seal members 56 of a resilient material fixedly mounted on respective open ends thereof, and have respective discharge openings 10*a* defined in closed ends or bottoms thereof. The resilient seal members 56 are held against the inner circumferential surface of the outer cylinder 2 for preventing a fluid discharged by the pump units from leaking back toward the pump suction port 2*d*.

The inner casings 10A, 10B house therein respective pairs of axially spaced retainers 46 which hold respective liner rings 45, respective return blades 47 for guiding a fluid discharged from the impellers 8A, 8C toward the impellers 8B, 8D, and respective return blades 47 for guiding the fluid discharged from the impellers 8B, 8D to flow toward the discharge openings 10*a*.

Other structural details of the double-suction-type full-circumferential-flow pump shown in FIG. 7 are identical to those of the pump shown in FIG. 3.

Operation of the double-suction-type full-circumferential-flow pump shown in FIG. 7 will be described below.

A fluid drawn in from the pump suction port 2*d* is divided into two flows in the annular flow passage 40, and the fluid flows are introduced through respective fluid guides 90 into the impellers 8A, 8C. The fluid flows are then discharged from the impellers 8A, 8C, and introduced through the respective return blades 47 into the impellers 8B, 8D. After being pressurized by the impellers 4B, 4D, the fluid flows are guided by the return blades 47 and then discharged from the respective discharge openings 10*a* of the inner casings 10A, 10B. The fluid flows discharged from the discharge openings 10*a* pass through the respective discharge windows 2*b*, 2*c* in the outer cylinder 2 into the discharge pipe 61 where the fluid flows are combined with each other. The fluid in the discharge pipe 61 is thereafter discharged from the discharge port 61*a* and the discharge nozzle 62.

The double-suction-type full-circumferential-flow pump shown in FIG. 7 may be combined with the frequency converters F, thereby providing the group of double-suction-type full-circumferential-flow pumps that are rotatable at high speeds and belong to the type E for applications to pump a fluid at a large rate under a high pump head.

Specific structural details of each of the double-suction-type full-circumferential-flow pumps that belong to the types D and E will be described below with reference to FIGS. 8 and 9. The double-suction-type full-circumferential-flow pump shown in FIGS. 8 and 9 is combined with a frequency converter for use as the type E.

Figure 8:
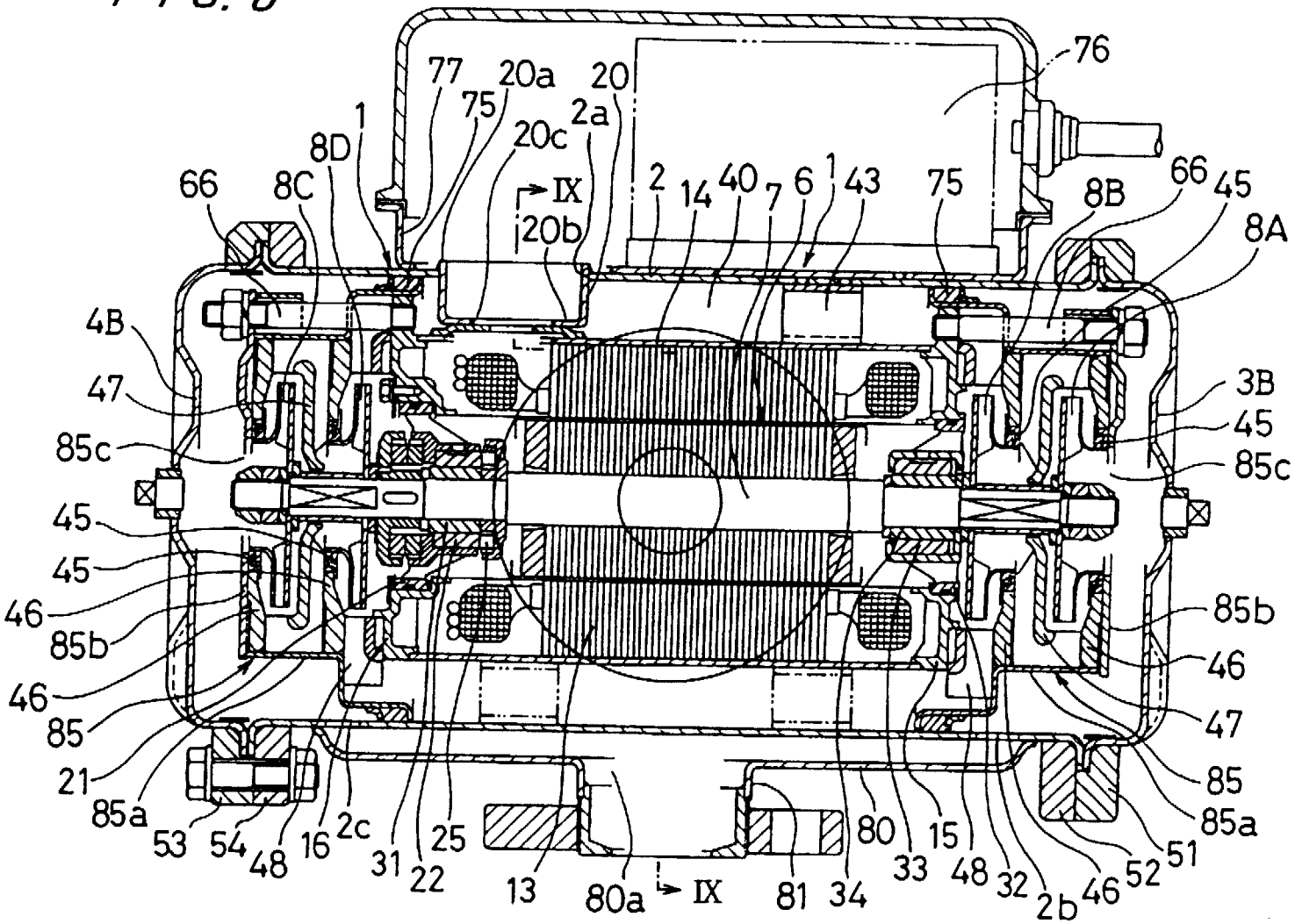
FIG. 8 is a vertical cross-sectional view of still another one of the full-circumferential-flow pumps according to the present invention.
Figure 9:
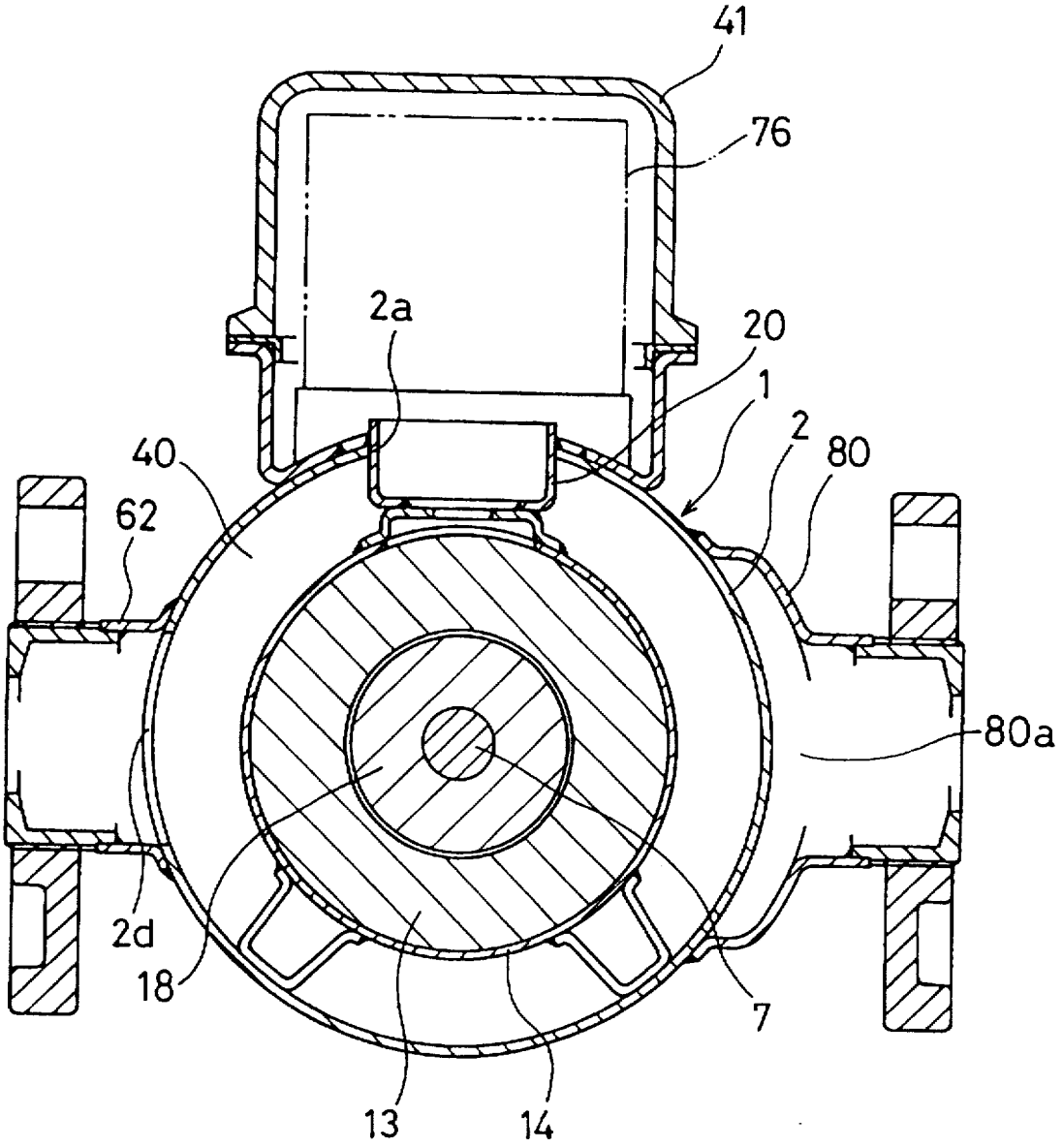
FIG. 9 is a cross-sectional view taken along line IX—IX of FIG. 8.

As shown in FIGS. 8 and 9, the double-suction-type full-circumferential-flow pump comprises a pump casing 1, a canned motor 6 disposed centrally therein, and pairs of impellers 8A, 8B and impellers 8C, 8D mounted respectively on opposite ends of a main shaft 7 of the canned motor 6. The impellers 8A, 8B, 8C, 8D have respective suction mouths opening axially outwardly.

The pump casing 1 comprises a cylindrical outer cylinder 2 of sheet stainless steel, and covers 3B, 4B of sheet stainless steel connected to respective opposite ends of the outer casing 2 by flanges 51, 52 and flanges 53, 54, respectively. The outer cylinder 2 has axially spaced suction windows 2*b*, 2*c* defined in its circumferential wall near the respective opposite ends thereof and interconnected by a suction cover 80 mounted on the outer circumferential surface of the outer cylinder 2. The suction cover 80 has a suction port 80*a* defined therein, and a suction nozzle 81 is fixed to an outer surface of the suction cover 80 over the suction port 80*a*.

The canned motor 6 is of a structure which is essentially the same as the canned motor 6 shown in FIG. 3.

An inverter 76 is housed in a case 77 which is welded to an outer cylindrical surface of the outer cylinder 2. The outer cylinder 2 has a hole 2*a* defined therein which receives a terminal case 20. The terminal case 20 has a side wall 20*a* welded to the outer cylinder 2 and a bottom wall 20*b* resting on the outer motor frame 14 of the canned motor 6 and having a hole 20*c* defined therein. Leads from the inverter 76 are connected to terminals in the terminal case 20, which are connected to the coils of the stator 13 of the canned motor 6.

The outer cylinder 2 houses axially spaced inner casings 85 which accommodate the respective pairs of impellers 8A, 8B and impellers 8C, 8D. The inner casings 85 are essentially cylindrical in shape, and comprise respective cylindrical members 85*a* and respective covers 85*b* mounted on respective outer ends of the cylindrical members 85*a*. Resilient annular seals 75 are disposed around respective inner ends of the cylindrical members 85*a* and held against an inner circumferential surface of the outer cylinder 2 for preventing a fluid from leaking from a discharge region back into a suction region. The covers 85*b* have respective suction openings 85*c* defined therein around the opposite ends of the main shaft 7 and communicating respectively with the suction mouths of the impellers 8A, 8C.

The inner casings 85 are connected to the respective side frame plates 15, 16 of the canned motor 6 by respective bolts 66. The inner casings 85 houses therein respective pairs of axially spaced retainers 46 retaining respective liner rings 45, a pair of respective return blades 47 for guiding a fluid discharged from the impellers 8A, 8C toward the impellers 8B, 8D, and a pair of respective guide units 48 for guiding a fluid discharged radially outwardly from the impellers 8B, 8D to flow axially.

The outer motor frame 14 is fixedly supported in and spaced radially inwardly of the outer cylinder 2 by stays 43 with an annular fluid passage 40 defined therebetween.

As shown in FIG. 9, the outer cylinder 2 has a discharge window **2*e* defined therein, and a discharge nozzle 62 is mounted on the outer circumferential surface of the outer cylinder 2 over the discharge window 2*e***.

The main shaft 7 is rotatably supported by bearing assemblies that are essentially identical to the bearing assemblies shown in FIG. 3.

Operation of the double-suction-type full-circumferential-flow pump shown in FIGS. 8 and 9 will be described below.

A fluid which is drawn in through the suction port **80*a* flows into and is divided into two flows in the suction cover 80. The fluid flows are then introduced through the suction windows 2*b*, 2*c* and flow through the suction openings 85*c* into the impellers 8A, 8C. The fluid flows are then pressurized by the impellers 8A, 8B, 8C, 8D, and discharged from the impellers 8B, 8D. The fluid flows are guided by the guide units 48 to flow axially into the annular fluid passage 40. In the annular fluid passage 40, the fluid flows are combined with each other. The fluid is thereafter discharged from the discharge port 2*e* and the discharge nozzle 62**.

When the inverter 76 is removed, the double-suction-type full-circumferential-flow pump is suitable for use as the type D.

According to the present invention, the group of motors M, the group of pump parts P, and the group of frequency converters F may appropriately be combined to provide a group of single-suction-type full-circumferential-flow pumps that are powered by a commercial electric power supply and belong to the type A for applications to pump a fluid at a small rate under a low pump head, and a group of single-suction-type full-circumferential-flow pumps that are rotatable at high speeds and belong to the type B for applications to pump a fluid at a small rate under a high pump head. All of the group of motors M, the group of pump parts P, and the group of frequency converters F may be combined to provide a group of double-suction-type full-circumferential-flow pumps that are powered by a commercial electric power supply and belong to the type D for applications to pump a fluid at a large rate under a low pump head, and a group of double-suction-type full-circumferential-flow pumps that are rotatable at high speeds and belong to the type E for applications to pump a fluid at a large rate under a high pump head. A group of single-suction-type balanced multistage full-circumferential-flow pumps belongs to the type C which is included in the type B.

The groups of pumps according to the present invention can share the following parts:

(1) Impellers and associated parts;

(2) Bearings and associated parts such as bearing brackets, etc.;

(3) Outer cylinders and casing flanges by which outer casings are fixed;

(4) Suction and discharge flanges; and (5) Other principal motor parts.

Consequently, groups of full-circumferential-flow pumps can be manufactured using the above shared parts, with variations of axial dimensions, welding of parts to outer cylinders, modifications of outer casings attached to axial open ends of outer cylinders, and selective attachment of frequency converters.

Although certain preferred embodiments of the present invention have been shown and described in detail, it should be understood that various changes and modifications may be made therein without departing from the scope of the appended claims.

What is claimed is:

1. A group of full-circumferential-flow pumps comprising:

a group of motors, each comprising a main shaft, a rotor mounted on said main shaft, a stator disposed around said rotor, a cylindrical outer motor frame fitted over said stator, and an outer cylinder disposed around said cylindrical outer motor frame with an annular space defined therebetween;

a group of pump parts including at least an impeller; and a group of frequency converters for energizing said motors to rotate at high speeds by raising the frequency of a commercial electric power supply;

wherein at least some of said group of motors, said group of pump parts and said group of frequency converters are combined to provide at least one single-suction type full-circumferential-flow pump of a first type lacking a frequency converter and providing a certain pump head at a certain flow rate using a certain number of said impellers, and at least one single-suction-type full-circumferential-flow pump of a second type having a frequency converter and providing a pump head greater than said certain pump head and having a number of impellers which is not greater than said certain number of impellers.

2. A group of full-circumferential-flow pumps according to claim 1, wherein said group of motors and said group of pump parts are combined to provide a group of double-suction-type full-circumferential-flow pumps that are powered by a commercial electric power supply and belong to a third type for applications to pump a fluid at a large rate under a low pump head.

3. A group of full-circumferential-flow pumps according to claim 1, wherein said group of motors, said group of pump parts, and said group of frequency converters are combined to provide a group of double-suction-type full-circumferential-flow pumps that are rotatable at high speeds and belong to a fourth type for applications to pump a fluid at a large rate under a high pump head.

4. A group of full-circumferential-flow pumps according to claim 1, wherein said group of motors, said group of pump parts, and said group of frequency converters are combined to provide a group of single-suction-type balanced multistage full-circumferential-flow pumps which belong to a fifth type which is included in said second type.

5. A group of full-circumferential-flow pumps according to claim 1, wherein said at least one single-suction-type full-circumferential-flow pump of a second type has a number of impellers which is fewer than said certain number of impellers.

6. A method of manufacturing a group of full-circumferential-flow pumps comprising the steps of:

providing a group of motors, each comprising a main shaft, a rotor mounted on said main shaft, a stator disposed around said rotor, a cylindrical outer motor frame fitted over said stator, and an outer cylinder disposed around said cylindrical outer motor frame with an annular space defined therebetween;

providing a group of pump parts including at least an impeller;

providing a group of frequency converters for energizing said motors to rotate at high speeds by raising the frequency of a commercial electric power supply;

combining at least some of said group of motors, said group of pump parts and said group of frequency converters to provide at least one single-suction type full-circumferential-flow pump of a first type lacking a frequency converter and providing a certain pump head at a certain flow rate using a certain number of said impellers; and combining at least some of said group of motors, said group of pump parts and said group of frequency converters to provide at least one single-suction-type full-circumferential-flow pump of a second type having a frequency converter and providing a pump head greater than said certain pump head and having a number of impellers which is not greater than said certain number of impellers.

7. A method according to claim 6, further comprising the step of combining said group of motors and said group of pump parts to provide a group of double-suction-type full-circumferential-flow pumps that are powered by a commercial electric power supply and belong to a third type for applications to pump a fluid at a large rate under a low pump head.

8. A method according to claim 6, further comprising the step of combining said group of motors, said group of pump parts, and said group of frequency converters to provide a group of double-suction-type full-circumferential-flow pumps that are rotatable at high speeds and belong to a fourth type for applications to pump a fluid at a large rate under a high pump head.

9. A method according to claim 6, further comprising the step of combining said group of motors, said group of pump parts, and said group of frequency converters to provide a group of single-suction-type balanced multistage full-circumferential-flow pumps which belong to a fifth type which is included in said second type.

10. A method according to claim 6, wherein said step of providing at least one single-suction-type full-circumferential-flow pump of a second type comprises providing at least one single-suction-type full-circumferential-flow pump having a number of impellers which is fewer than said certain number of impellers.

* * * * *